US008496763B2

(12) United States Patent
Arai et al.

(10) Patent No.: US 8,496,763 B2
(45) Date of Patent: Jul. 30, 2013

(54) SEAMLESS STEEL TUBE FOR AN AIRBAG ACCUMULATOR AND PROCESS FOR ITS MANUFACTURE

(75) Inventors: Yuji Arai, Osaka (JP); Takashi Takano, Osaka (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 638 days.

(21) Appl. No.: 12/429,851

(22) Filed: Apr. 24, 2009

(65) Prior Publication Data

US 2009/0238714 A1 Sep. 24, 2009

Related U.S. Application Data

(63) Continuation of application No. PCT/JP2007/070088, filed on Oct. 15, 2007.

(30) Foreign Application Priority Data

Oct. 27, 2006 (JP) ..... 2006-293058

(51) Int. Cl.

| | |
|---|---|
| ***C22C 38/22*** | (2006.01) |
| ***C22C 38/26*** | (2006.01) |
| ***C22C 38/28*** | (2006.01) |
| ***C21D 8/10*** | (2006.01) |
| ***C21D 9/14*** | (2006.01) |

(52) U.S. Cl.

USPC ..... 148/334; 148/335; 148/590; 148/593; 148/909

(58) Field of Classification Search

USPC ..... 148/593, 650, 651, 590, 334, 335, 148/909

See application file for complete search history.

(56) References Cited

U.S. PATENT DOCUMENTS

2002/0033591 A1 3/2002 Erike
2003/0155052 A1 8/2003 Kondo et al.

(Continued)

FOREIGN PATENT DOCUMENTS

EP 1516935 A1 3/2005
JP 08-325641 12/1996

(Continued)

OTHER PUBLICATIONS

Machine-English translation of Japanese patent 2005-060795, Miyata Yukio et al., Mar. 10, 2005.*

(Continued)

*Primary Examiner* — Deborah Yee

(74) *Attorney, Agent, or Firm* — Marshall, Gerstein & Borun LLP

(57) ABSTRACT

A seamless steel tube for an airbag accumulator which can be manufactured by heat treatment of normalizing without quenching and tempering and which has a tensile strength of at least 850 MPa and resistance to bursting at −20° C. has a stee; composition comprising, in mass %, C: 0.08-0.20%, Si: 0.1-1.0%, Mn: 0.6-2.0%, P: at most 0.025%, S: at most 0.010%, Cr: 0.05-1.0%, Mo: 0.05-1.0%, Al: 0.002-0.10%, at least one of Ca: 0.0003-0.01%, Mg: 0.0003-0.01%, and REM (rare earth metals): 0.0003-0.01%, at least one of Ti: 0.002-0.1% and Nb: 0.002-0.1%, with Ceq which is defined by the following Equation (1) being in the range of 0.45-0.63, with the metallurgical structure being a mixed structure of ferrite+bainite:

$$Ceq=C+Si/24+Mn/6+(Cr+Mo)/5+(Ni+Cu)/15 \quad (1)$$

wherein the symbol for each element in Equation (1) indicates the number expressing the mass percent of the element.

8 Claims, 1 Drawing Sheet

U.S. PATENT DOCUMENTS

| | | | | |
|---|---|---|---|---|
| 2005/0000601 | A1 | 1/2005 | Arai et al. | |
| 2006/0070687 | A1 * | 4/2006 | Miyata et al. | 148/593 |
| 2006/0124211 | A1 | 6/2006 | Takano et al. | |

FOREIGN PATENT DOCUMENTS

| | | | |
|---|---|---|---|
| JP | 10-140249 | | 5/1998 |
| JP | 10-140250 | | 5/1998 |
| JP | 10-140283 | | 5/1998 |
| JP | 410140249 | A * | 5/1998 |
| JP | 11-199929 | | 7/1999 |
| JP | 2002-294339 | | 10/2002 |
| JP | 2004-027303 | | 1/2004 |
| JP | 2005-060795 | | 3/2005 |
| WO | WO 2004/104255 | | 12/2004 |

OTHER PUBLICATIONS

Machine-English translation of Japanese patent 2005-146414, Yamazaki Yoshio et al., Jun. 9, 2005.*

International Search Report in corresponding PCT/JP2007/070088 dated Jan. 15, 2008.

European search report from corresponding European application No. EP 07829822.1, dated Jun. 5, 2011.

* cited by examiner

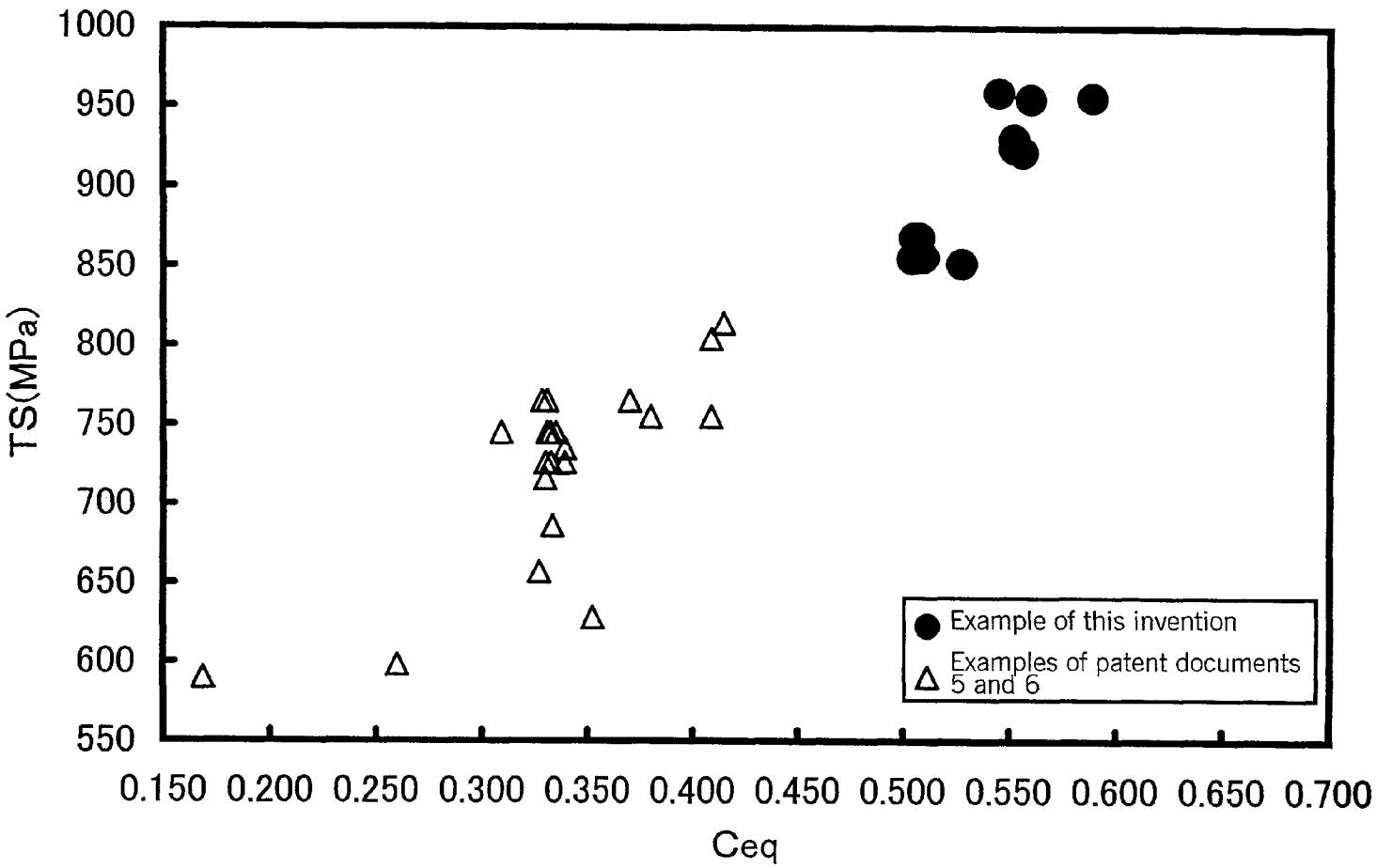
TS(MPa)
1000
950
900
850
800
750
700
650
600
550
0.150
0.200
0.250
0.300
0.350
0.400
0.450
0.500
0.550
0.600
0.650
0.700
Ceq
Example of this invention
Examples of patent documents 5 and 6

SEAMLESS STEEL TUBE FOR AN AIRBAG ACCUMULATOR AND PROCESS FOR ITS MANUFACTURE

TECHNICAL FIELD

This invention relates to a seamless steel tube suitable for use to fabricate an airbag accumulator for which high strength and high toughness are required and a process of inexpensively manufacturing the steel tube. In particular, the present invention relates to a seamless steel tube for an airbag accumulator having a high strength and a high toughness at such a level that it does not undergo brittle fracture when subjected to an internal pressure bursting test (a test for increasing the internal pressure of a closed tube until bursting occurs) at −20° C. and a process for its manufacture.

BACKGROUND ART

In recent years, the introduction of safety equipment is being actively promoted in the automotive industry. Among such equipment, airbag systems which rapidly expand an airbag with gas or the like between a passenger and a steering wheel, an instrument panel, or the like at the time of a collision before the passenger impacts the steering wheel, etc. so as to absorb the kinetic energy of the passenger and decrease his or her injury have been developed and installed in most automobiles.

Airbag systems using explosive chemicals to expand an airbag were generally employed in the past. However, in order to permit environmental recycling, airbag systems in which an airbag is expanded using a confined high pressure gas have been developed and are increasingly being used.

In the airbag system using a confined high pressure gas, a gas for expansion such as an inert gas (e.g., argon) which is blown into an airbag at the time of a collision is confined in a pressure accumulating vessel (accumulator) and always maintained therein at a high pressure. The gas is blown out all at once from the accumulator into an airbag at the time of a collision. The accumulator is generally fabricated by welding a lid to each end of a steel tube which has been cut to an appropriate length.

An accumulator for airbags (referred to herein as airbag accumulator or simply as accumulator) is always filled with a high pressure gas at around 300 kgf/cm$^2$, for example, and it must withstand such a high pressure for a long period. In addition, when the gas is blown out therefrom, the accumulator is subjected to stress at a high strain rate in an extremely short period of time, and it must withstand such a stress, too. In order to make it possible to reduce the size and weight of an airbag system, which leads to saving of milage of an automobile, an airbag accumulator is desired to have an increased gas pressure and a decreased wall thickness.

Accordingly, a seamless steel tube, which is generally more reliable than a welded steel tube at a high pressure, is used in the fabrication of an airbag accumulator. In contrast to a simple structure such as conventional pressure cylinders or line pipe, a steel tube for an airbag accumulator is desired to have a high tensile strength on the order of at least 850 MPa in order to sufficiently withstand the filled gas pressure and excellent low temperature burst resistance (or toughness) as indicated by a ductile fracture occurring in a bursting test at a temperature of −20° C. or below in view of the possibility of use at low temperatures, in addition to a high level of dimensional accuracy, workability, and weldability.

Seamless steel tubes suitable for use in an airbag accumulator and methods for their manufacture are disclosed in Patent Documents 1 to 4 cited below, for example.

In the methods proposed in these patent documents, a seamless steel tube having desired high strength and excellent burst resistance is manufactured by a process including quenching and tempering. However, heat treatment for quenching and tempering has the problem that it makes the manufacturing process complicated thereby decreasing productivity and increasing manufacturing costs. Accordingly, there is a demand for a method of manufacturing a seamless steel tube which can satisfy desired properties using heat treatment which can be performed easily.

Patent Document 5 discloses a method of manufacturing a seamless steel tube for an airbag accumulator in which quenching and tempering are not carried out as heat treatment. In this patent document, it is described that a high strength, high toughness steel tube having high dimensional accuracy and good workability and weldability can be manufactured by subjecting a steel tube as formed to normalizing at 850-1000° C. followed by cold working to obtain prescribed dimensions and optionally further followed by stress relief annealing, normalizing, or quenching and tempering. However, the technology disclosed in Patent Document 5 aims to manufacture a seamless steel tube having a tensile strength on the order of 590 MPa, and the values of tensile strength of the steel tubes which are obtained in the examples set forth therein is at most 814 MPa, which is insufficient to meet the demands for an increase in the pressure of filling gas and a decrease in weight due to a decrease in wall thickness in recent airbag accumulators.

Similarly, Patent Document 6 discloses a seamless steel tube for an airbag which is manufactured by cold working without heat treatment or with heat treatment in the form of annealing, normalizing, or quenching and tempering, with the object of attaining a tensile strength on the order of 590 MPa or higher. That document only discloses the type of heat treatment after cold working with no limitations on the conditions of the heat treatment, from which it is apparent that the object is to be achieved by means of the steel composition alone.

A method of manufacturing a seamless steel tube for an airbag having high strength, high toughness, and high workability in which heat treatment is carried out by normalizing instead of quenching and tempering is proposed in Patent Document 4.

In this method, a steel material having a composition comprising C: 0.01-0.10%, Si: at most 0.5%, Mn: 0.10-2.00%, Cr: greater than 1.0% up to 2.0%, Mo: at most 0.5%, and optionally at least one of Cu: at most 1.0%, Ni: at most 1.0%, Nb: at most 0.10%, V: at most 0.10%, Ti: at most 0.10%, and B: at most 0.005% is used to form a seamless steel tube, and the tube is then subjected to normalizing by heating at a temperature in the range of 850-1000° C. followed by air cooling and then to cold drawing to obtain prescribed dimensions. However, there are few examples relating to the conditions of normalizing. In addition, since the method is premised on a Cr content exceeding 1.0%, the alloy costs are relatively high, and the low temperature toughness is questionable.

In Patent Document 4, low temperature toughness is evaluated by a drop weight test. A drop weight test is also utilized in Patent Document 6 and other publications as a simple method for evaluating low temperature toughness. However, in Patent Document 6, seamless steel tubes which have undergone heat treatment such as annealing and those which are as cold worked were evaluated as having the same low temperature toughness in a drop weight test. In view of this, it is unconvincing that a drop weight test, which is merely a simple evaluation method, can properly evaluate the strict performance requirement desired for present-day airbag accumulators.

As suggested in the above-described patent document, cold working such as cold drawing is indispensable in the manufacture of a seamless steel tube for an airbag accumulator in order to increase the dimensional accuracy of outer diameter and wall thickness. As described in paragraphs 0003-0004 of Patent Document 7, an airbag accumulator is a part for which good dimensional accuracy of outer diameter is required for its assembling, but an increase of the wall thickness of the steel tube of an accumulator in order to increase its strength cannot be employed since it is necessary to avoid an increase in the weight of an automobile. In addition, an airbag is now installed not only for a driver seat, but for passenger seat and even for rear seats, and in order to install a plurality of airbags in one automobile, there is a growing demand for reduction of costs of accumulators.

Patent Document 1: JP H08-325641 A1
Patent Document 2: JP H10-140250 A1
Patent Document 3: JP 2002-294339 A1
Patent Document 4: JP 2004-27303 A1
Patent Document 5: JP H10-140249 A1
Patent Document 6: JP H10-140283 A1
Patent Document 7: JP H11-199929 A1

DISCLOSURE OF INVENTION

It is an object of the present invention to provide a seamless steel tube for an airbag accumulator which can be manufactured by employing only simple heat treatment without quenching and tempering and which has a tensile strength of at least 850 MPa and good low temperature burst resistance indicated by no brittle fracture occurring in a bursting test at −20° C. such that it can be adequately cope with increases in the gas pressure and decreases in the wall thickness of accumulators.

Another object of the present invention is to provide a process for manufacturing such a seamless steel tube for an airbag accumulator.

A decrease in the wall thickness and outer diameter of a steel tube for an airbag accumulator contributes not only to an increased milage of automobiles but also to a decrease in the costs of an airbag. Cold working applied after tube making is indispensable in order to guarantee the dimensional accuracy and have a decreased wall thickness and outer diameter. However, in reality, cold working has a significant influence on the low temperature toughness or burst resistance of a steel tube, and in particular as the strength of a steel tube increases, it becomes difficult to achieve good low temperature toughness or burst resistance. Therefore, it is necessary to decide the chemical composition of a steel and a heat treating process such that both high strength and good low temperature burst resistance can be attained.

The present inventors investigated the influence of the chemical composition, the metallurgical structure, and the conditions in various manufacturing steps on the strength and the low temperature burst resistance of a seamless steel tube for an airbag accumulator. As a result, it was found that by setting the carbon equivalent (referred to below for short as Ceq) to a suitable range and performing normalizing heat treatment, prior to cold drawing for finishing to desired final dimensions, so as to transform the metallurgical structure of a steel tube into a ferrite+bainite dual-phase structure, a seamless steel tube for an airbag accumulator having a tensile strength exceeding 850 MPa and having high burst resistance such that no cracks develop in a bursting test at −20° C. is obtained.

The present invention is a seamless steel tube for an airbag accumulator characterized by having a steel composition consisting essentially, in mass %, of C: 0.08-0.20%, Si: 0.1-1.0%, Mn: 0.6-2.0%, P: at most 0.025%, S: at most 0.010%, Cr: 0.05-1.0%, Mo: 0.05-1.0%, Al: 0.002-0.10%, at least one of Ca: 0.0003-0.01%, Mg: 0.0003-0.01%, and REM (rare earth metals): 0.0003-0.01%, at least one of Ti: 0.002-0.1% and Nb: 0.002-0.1%, with Ceq which is defined by the following Equation (1) being in the range of 0.45-0.63, and a remainder of Fe and impurities, with the metallurgical structure being a mixed structure of ferrite+bainite having an area fraction of bainite of at least 10%:

$$Ceq=C+Si/24+Mn/6+(Cr+Mo)/5+(Ni+Cu)/15 \quad (1)$$

wherein the symbol for each element in Equation (1) indicates the number expressing the mass percent of the element.

In the above-described composition, a portion of Fe may be replaced by one or two of Cu: 0.05-0.5% and Ni: 0.05-1.5%.

The present invention is also a process of manufacturing a seamless steel tube for an airbag accumulator comprising a step of forming a seamless steel tube having the above-described steel composition and a step of subjecting the steel tube to finishing cold working so as to provide it with prescribed dimensions and not comprising heat treatment by quenching and tempering, characterized in that the process comprising a step of performing normalizing heat treatment on the steel tube prior to the finishing cold working step by heating the steel tube to a temperature in the range from the $Ac_3$ transformation point to 1,000° C. followed by air cooling.

A prescribed dimensional accuracy and a good surface condition can be afforded to a steel tube for an airbag accumulator by finally performing cold working such as cold drawing thereon. However, cold working may decrease the toughness of the tube so that good burst resistance cannot be obtained. Therefore, in the past, quenching and tempering were normally carried out before or after cold working so as to transform the metallurgical structure into tempered martensite or tempered bainite. However, quenching and tempering heat treatment itself requires a high temperature and a long processing time, and it further necessitates an additional step such as bend removal after quenching, leading to a decrease in productivity and an increase in manufacturing costs.

As a result of studying various types of heat treatment as a replacement for quenching and tempering prior to cold working of a steel tube, it was found that adjustment of the metallurgical structure to a ferrite+bainite dual phase structure by adjusting the contents of individual elements and Ceq of steel composition and performing normalizing makes it possible to obtain both a high strength and a good burst resistance.

In recent years, with the aim of decreasing in weight of an accumulator, it has been attempted to decrease its wall thickness. As a result, bigger dimensional changes tend to develop at the time of quenching and tempering, which is becoming a major technical problem. Today, the wall thickness of a steel tube for accumulator is decreased to 2.5-2.0 mm, and thus a tensile strength of at least 850 MPa is demanded of the tube.

According to the present invention, a steel tube having a high tensile strength of at least 850 MPa and high burst resistance such that cracks do not develop in a bursting test at −20° C. is obtained without quenching and tempering heat treatment before or after cold working which is performed to achieve dimensional accuracy. Therefore, a seamless steel tube for an airbag accumulator can be provided which can adequately cope with increases in accumulator pressure and decreases in the wall thickness of steel tubes and which can be manufactured inexpensively and with high efficiency.

BRIEF EXPLANATION OF THE DRAWING

FIG. 1 is a graph comparing the relationship between Ceq and tensile strength for a steel according to the present invention and for a conventional material.

BEST MODE FOR CARRYING OUT THE INVENTION (A) Chemical Composition and Metallurgical Structure of a Steel Tube The reasons for defining the chemical composition of a steel in the present invention as described above are as follows. In this description, unless otherwise specified, % means mass %.

C: 0.08-0.20%

C is an element which is effective at inexpensively increasing the strength of steel, but if its content is less than 0.08%, it is difficult to achieve a desired tensile strength of at least 850 MPa without carrying out quenching and tempering heat treatment. On the other hand, if the C content exceeds 0.20%, the workability and weldability of steel decrease. A preferred range for the C content is 0.08-0.16%, and a more preferred range therefor is 0.09-0.13%.

Si: 0.1-1.0%

Si is an element which has a deoxidizing action and increases the hardenability of steel so as to increase its strength. For this purpose, it is necessary for its content to be at least 0.1%. However, if its content exceeds 1.0%, toughness decreases. A preferred range for the Si content is 0.2-0.5%.

Mn: 0.6-2.0%

Mn makes it easier to obtain a ferrite+bainite dual phase structure during air cooling after normalizing. As such, it is effective at increasing the strength and toughness of steel. If the Mn a content is less than 0.6%, a sufficient strength and toughness are not obtained, while if its content exceeds 2.0%, the weldability of steel worsens. A preferred range for the Mn content is 0.8-1.8%, and a more preferred range is 1.0-1.6%.

P: at most 0.025%

P brings about a decrease in toughness caused by grain boundary segregation, and the toughness of steel markedly decreases when its content exceeds 0.025%. The P content is preferably at most 0.020% and still more preferably at most 0.015%.

S: at most 0.010%

S decreases the toughness particularly in the circumferential direction (T direction) of a steel tube. In particular, the toughness markedly decreases if its content exceeds 0.010%. The content of S is preferably at most 0.005% and still more preferably at most 0.003%.

Cr: 0.05-1.0%

Cr is an element which is effective at increasing the strength and toughness of steel without quenching and tempering heat treatment, and thus it is necessary for its content to be at least 0.05%. However, if its content exceeds 1.0%, it leads to a decrease in toughness. A preferred range for the Cr content is 0.2-0.8% and a more preferred range is 0.4-0.7%.

Mo: 0.05-1.0%

Mo is also an element which is effective at increasing the strength and toughness of steel without quenching and tempering heat treatment, and thus it is contained in steel at a content of at least 0.05%. However, if its content exceeds 1.0%, it leads to a decrease in toughness. A preferred range for the Mo content is 0.1-1.0% and a more preferred range is 0.15-0.70%.

Al: 0.002-0.10%

Al is an element which has a deoxidizing action and which is effective at increasing the toughness and workability of steel. If the Al content is less than 0.002%, deoxidation becomes inadequate such that the cleanliness of steel is worsened and its toughness decreases. However, the presence of Al at a content exceeding 0.10% again leads to a decrease in toughness. A preferred range for the Al content is 0.005-0.08% and a more preferred range is 0.01-0.06%. The Al content in the present invention indicates the content of acid-soluble Al (so-called "sol. Al").

One or more of Ca, Mg, and REM: 0.0003-0.01% each

Each of Ca, Mg, and REM (rare earth metals such as Ce, La, Y, Nd, and the like) bonds with S in steel and acts to fix S as a sulfide. By this action, it has the effect of improving the anisotropy of toughness of steel and increasing its burst resistance. Thus, in the present invention which does not rely on improving toughness by quenching and tempering, an improvement in the anisotropy of toughness by Ca, Mg, and/or REM is indispensable. In order to obtain this effect, at least one element selected from Ca, Mg, and REM is added at a content of at least 0.0003%. REM may be added as individual elements such as Ce, La, Y, Nd and the like, or they may added in the form of a REM mixture such mish metal. However, if its content exceeds 0.01%, inclusions form clusters, and toughness ends up decreasing. A preferred range for its content is 0.0005-0.005% each.

At least one of Nb and Ti: 0.002-0.1% each

Each of Nb and Ti forms a carbonitride at the time of heating for normalizing heat treatment, thereby refining austenite grain diameters and in turn, promoting refinement of ferrite+bainite which is formed by a phase transformation at the time of air cooling, and thus increasing the toughness of steel. Nb and Ti are thought to equally provide this effect, so either one of Nb and Ti may be present at a content of at least 0.002%. However, in order to achieve the above-described effect more markedly, it is preferred that, both Nb and Ti be contained in amount of at least 0.002% each. If the content of each of these elements exceeds 0.1%, the toughness of steel ends up decreasing. A preferred range for Nb and Ti is 0.003-0.1% each and a more preferred range is 0.005-0.08% each.

When both Nb and Ti are added, the total of the contents of these elements is preferably at least 0.003% and at most 0.1%, and more preferably it is in the range of 0.005-0.08%. In this case, the content of each of Nb and Ti is preferably in the range of 0.005-0.05%.

Ceq: 0.45-0.63

In order to provide a steel tube with both strength and burst resistance to a level required for a steel tube for an airbag accumulator by normalizing instead of quenching and tempering as heat treatment, it is necessary to form a ferrite+bainite dual phase structure by normalizing. For this purpose, it is important to obtain a suitable balance of the contents of C, Si, Mn, Cr, Mo, Cu, and Ni. A suitable balance is obtained when the value of Ceq defined by the following equation is in the range of 0.45-0.63. If Ceq is less than 0.45, the metallurgical structure after normalizing becomes a ferrite+pearlite dual phase structure, and it becomes difficult to achieve both a high strength and low temperature toughness. On the other hand, if Ceq exceeds 0.63, low temperature toughness ends up decreasing. A preferred range for Ceq is 0.47-0.62, and a more preferred range for Ceq is 0.50-0.60.

$$Ceq=C+Si/24+Mn/6+(Cr+Mo)/5+(Cu+Ni)/15 \quad (1)$$

The symbol for each element in Equation (1) indicates the value of the element in mass percent. Cu and Ni are optional elements, so when they are not added, the symbols for these elements in Equation (1) are set to 0.

The composition of a steel according to the present invention may further contain at least one of the following optional elements.

Ni: 0.05-1.5%

Ni has the effects of making it easier to obtain a ferrite+bainite dual phase structure during air cooling after normalizing and of increasing the toughness of steel. These effects of Ni are obtained even when its content is on the level of an impurity, but in order to more markedly obtain these effects, Ni is preferably added at a content of at least 0.05%. However, Ni is an expensive element, and costs markedly increase when its content exceeds 1.5%. Accordingly, when Ni is added, its content is preferably 0.05-1.5%. A more preferable Ni content is 0.1-1.0%.

Cu: 0.05-0.5%

Cu has the effects of making it easier to obtain a ferrite+bainite dual phase structure during air cooling after normalizing and of increasing toughness. In order to obtain these effects, it is preferable to make the Cu content at least 0.05%. However, if Cu is added in excess of 0.5%, the hot workability of steel decreases. Accordingly, when Cu is added, its content is preferably 0.1-0.4%.

Metallurgical structure: ferrite+bainite dual phase structure

In the present invention, a steel tube having desired strength and low temperature toughness can be obtained without quenching and tempering by providing the steel tube with a ferrite+bainite dual phase structure.

The ferrite+bainite dual phase structure as used herein means a structure comprising predominantly ferrite and bainite. When the metallurgical structure contains a third phase such as pearlite, if the area fraction of the phase or phases other than "ferrite and bainite" is less than 10%, the strength and toughness of steel are not significantly affected. Therefore, the ferrite+bainite dual phase structure encompasses structures containing other phase or phases at an area fraction of less than 10%. The ferrite+bainite dual phase structure contains bainite at an area fraction of at least 10%. This is because if the area fraction of bainite is less than 10%, the dual phase act in substantially the same manner as a single ferrite phase, thereby making it difficult to achieve the desired properties in both strength and low temperature toughness. Accordingly, even if the area fraction of phases other than ferrite and bainite is less than 10%, a structure in which the area fraction of bainite is less than 10% does not fall under the ferrite+bainite dual phase structure intended by the present invention.

Like a usual manufacturing process for a seamless steel tube, a manufacturing process for a seamless steel tube according to the present invention basically includes the steps of tube forming, heat treatment, and finishing cold working. A characteristic of a manufacturing process according to the present invention is that quenching and tempering heat treatment are not carried out.

(B) Tube Forming

A seamless steel tube is formed using a steel having its chemical composition adjusted as described above as a starting material. There are no particular restrictions on the method of forming the seamless steel tube. An example of such a method is a hot tube manufacturing method in which includes a mother tube is prepared by piercing and elongation rolling by the Mannesman mandrel mill method and is subjected to rolling for reduction in diameter with a sizer or a reducer.

(C) Normalizing Heat Treatment

A seamless steel tube as formed is subjected to normalizing as heat treatment. A heating temperature for normalizing exceeding 1,000° C. leads to a coarsening of austenite grains, and in turn, the ferrite grain diameter formed by the phase transformation during air cooling ends up coarsening. On the other hand, if the heating temperature for normalizing falls below the $Ac_3$ transformation point, although heating is performed, carbides which precipitate at the time of tube formation are not dissolved and are non-uniformly coarsened, leading to a decrease in toughness. Accordingly, the heating temperature for normalizing is in the range of at least the $Ac_3$ transformation point to at most 1,000° C. The normalizing heat treatment causes the formation of a ferrite+bainite dual phase structure during air cooling after heating. After this normalizing heat treatment, the steel tube may be descaled, if necessary, by pickling or the like.

In order to decrease the load during finishing cold working, prior to the normalizing treatment, cold working may be performed as rough working on the seamless steel tube as formed may be subjected to cold working as rough working. The anisotropy of properties which develop by the rough cold working does not offer any problems since it is eliminated by the subsequent normalizing heat treatment. The reduction in area in the rough cold working is preferably at most 50%.

(D) Finishing Cold Working

A seamless steel tube which is formed and heat-treated in the manner described above undergoes cold working under conditions selected such that a prescribed dimensional accuracy and surface condition are obtained. The cold working can be carried out in any manner as long as a prescribed dimensional accuracy and surface condition can be obtained, and there are no particular restrictions with respect to the method which is employed. The cold working may be cold drawing, cold rolling, or the like, and two or more methods may be used. The degree of working is preferably such that the reduction in area is at least 3%.

(E) Stress Relief Annealing

Since residual stresses develop in a steel tube subjected to finishing cold working, stress relief annealing is preferably carried out thereon. From the standpoints of strength and toughness, the temperature for stress relief annealing is preferably in the range of 450-650° C.

After the above-described manufacturing steps, if necessary, bend straightening can be carried out by a straightener comprising a combination of grooved rolls to obtain a product.

EXAMPLES

The following examples illustrate the present invention, but they are not intended to restrict the present invention in any manner.

Example 1

In this example, steel plates of many steel materials having different chemical compositions were used to test them for tensile strength, low temperature toughness, and metallurgical structure.

Steel ingots weighing 50 kg and having the chemical compositions shown in Table 1 were prepared by vacuum melting. Steels No. 1-10 in Table 1 were steels for which the contents of the respective elements and Ceq satisfied the conditions prescribed by the present invention, while steels No. 11-15 were steels for which the content of at least one element or Ceq did not satisfy the conditions of the present invention. All the steels had an $Ac_1$ transformation point in the range of 710-770° C. and an $Ac_3$ transformation point in the range of 820-880° C.

The steel ingots were heated to 1250° C. and then hot rolled to form steel plates with a thickness of 10 mm. Next, the hot rolled steel plates were subjected to heat treatment and cold rolling under the conditions shown in Table 2 to prepare plate samples for evaluation. Namely, each hot rolled steel plate was subjected to heat treatment for normalizing by heating to 900° C. and soaking for 10 minutes at that temperature followed by air cooling. The air cooling at this time had an average cooling rate of 2-3° C. per second from 800° C. down to 500° C. The normalized steel plate was cold rolled to a finishing thickness of 6 mm, and then subjected to heat treatment for stress relief annealing by heating to a temperature in the range from 450-600° C. and soaking for 20 minutes at that temperature followed by air cooling. A tensile test, a Charpy impact test, and observation of the metallurgical structure were carried out on the sample plates which were prepared in this manner. The test results are also shown in Table 2.

The tensile test was carried out using a rod-shaped test piece with a diameter of 4 mm and a length of the parallel portion of 34 mm cut from each plate in a direction perpendicular to the rolling direction of the plate. The tensile test was carried out in accordance with the tensile test method for metallic materials specified in JIS Z 2241.

For the Charpy impact test, a rectangular parallelepiped with a length of 55 mm, a width of 4 mm, and a thickness of 10 mm was cut from each plate in the direction perpendicular to the rolling direction of the plate, and a subsize test piece was prepared therefrom by forming a V-shaped notch at the center of the length of the parallelepiped in the thickness direction with a notch angle of 45°, a notch depth of 2 mm, and a radius of the notch bottom of 0.25 mm. Using such test pieces, a Charpy impact test was carried out in accordance with the Charpy impact test method for metallic materials prescribed by JIS Z 2242 01 at different temperatures to determine the lowest test temperature at which the fracture was 100% ductile (vTr 100).

The metallurgical structure was observed using a longitudinal cross section of the plate as surface for observation. A cube measuring 10 mm on each side which was cut from the plate was embedded in a resin and polished, the surface for observation was etched with a nital etching solution, and the etched surface was observed with an optical microscope. The metallurgical structure was evaluated as follows:

(1) a structure comprising predominantly ferrite in which the area fraction of bainite is at least 10% and that of pearlite is less than 10%: a ferrite+bainite dual phase; and (2) a structure comprising predominantly ferrite in which the area fraction of pearlite is at least 10% and that of bainite is less than 10%: a ferrite+pearlite dual phase.

Within the range of the steel compositions for testing shown in Table 1, structures other than the above-described (1) and (2) were not observed.

The results of the tensile test and the Charpy impact test were evaluated as follows to determine if the material was suitable for a steel tube for use as an airbag accumulator. For the tensile test, the case in which the tensile strength was at least 850 MPa was acceptable and the case in which it was less than this value was unacceptable. For the Charpy impact test, the case in which the lowest test temperature at which the fracture was 100% ductile (vTr 100) was −20° C. or lower was acceptable, and the case in which the lowest test temperature was higher than this value was unacceptable.

TABLE 1

Chemical composition of steel (mass %, balance: Fe and impurities)

| Steel No. | C | Si | Mn | P | S | Cu | Cr | Ni | Mo | Ti | Nb | solAl | Ca, Mg. REM | Ceq |
|---|---|---|---|---|---|---|---|---|---|---|---|---|---|---|
| 1 | 0.11 | 0.28 | 1.33 | 0.016 | 0.0023 | | 0.62 | | 0.20 | 0.012 | 0.028 | 0.035 | Ca: 0.0018 | 0.507 |
| 2 | 0.16 | 0.28 | 1.31 | 0.015 | 0.0031 | | 0.61 | | 0.20 | 0.012 | 0.026 | 0.037 | Ca: 0.0020 | 0.552 |
| 3 | 0.11 | 0.28 | 1.33 | 0.010 | 0.0025 | 0.25 | 0.60 | 0.24 | 0.30 | 0.028 | 0.024 | 0.035 | Ca: 0.0021 | 0.556 |
| 4 | 0.11 | 0.27 | 1.33 | 0.016 | 0.0031 | | 0.61 | | 0.20 | 0.010 | 0.013 | 0.036 | Ca: 0.0024 | 0.505 |
| 5 | 0.11 | 0.28 | 1.32 | 0.018 | 0.0026 | | 0.61 | | 0.20 | 0.010 | | 0.035 | Ca: 0.0024 | 0.504 |
| 6 | 0.11 | 0.27 | 1.30 | 0.016 | 0.0028 | 0.20 | 0.61 | 0.21 | 0.20 | 0.011 | | 0.036 | Ca: 0.0024 | 0.527 |
| 7 | 0.11 | 0.28 | 1.31 | 0.018 | 0.0028 | 0.20 | 0.61 | 0.21 | 0.10 | 0.010 | | 0.034 | Ca: 0.0026 | 0.509 |
| 8 | 0.11 | 0.27 | 1.30 | 0.014 | 0.0028 | 0.20 | 0.61 | 0.25 | 0.31 | 0.011 | | 0.036 | Mg: 0.0012 | 0.552 |
| 9 | 0.11 | 0.28 | 1.31 | 0.014 | 0.0025 | 0.20 | 0.61 | 0.18 | 0.10 | | 0.025 | 0.034 | REM: 0.0025 | 0.507 |
| 10 | 0.11 | 0.32 | 1.28 | 0.012 | 0.0018 | 0.20 | 0.61 | 0.20 | 0.50 | 0.010 | | 0.034 | Ca: 0.0017 | 0.589 |
| 11 | 0.11 | 0.27 | 0.82 | 0.019 | 0.0030 | | 0.82 | | 0.05 | 0.012 | 0.031 | 0.036 | Ca: 0.0018 | 0.432* |
| 12 | 0.11 | 0.28 | 1.90 | 0.017 | 0.0030 | | 0.95 | | 0.05 | 0.010 | 0.028 | 0.033 | Ca: 0.0018 | 0.638* |
| 13 | 0.11 | 0.26 | 1.34 | 0.017 | 0.0030 | | 0.61 | | 0.20 | 0* | 0* | 0.034 | Ca: 0.0029 | 0.506 |
| 14 | 0.16 | 0.26 | 0.56* | 0.011 | 0.0020 | 0.31 | 0.75 | 0.30 | 0.30 | 0.007 | 0.022 | 0.025 | Ca: 0.0012 | 0.515 |
| 15 | 0.15 | 0.28 | 1.30 | 0.015 | 0.0020 | | 0.59 | | 0.16 | 0.025 | 0.024 | 0.032 | 0* | 0.528 |

*Outside the range defined herein.

TABLE 2

| Steel No. | Heat treatment of rough plate | Cold rolling after heat treatment | Heat treatment after cold rolling | Metallurgical structure | TS(MPa) | vTr100 (° C.) |
|---|---|---|---|---|---|---|
| 1 | Soaking for 10 minutes at 900° C. then air cooling | Rolling from 10 mm to 6 mm thick | Soaking for 20 minutes at 550° C. then air cooling | ferrite + bainite dual phase | 869 | −30 |
| 2 | Soaking for 10 minutes at | Rolling from 10 mm to 6 mm thick | Soaking for 20 minutes at | ferrite + bainite dual phase | 925 | −30 |

TABLE 2-continued

| Steel No. | Heat treatment of rough plate | Cold rolling after heat treatment | Heat treatment after cold rolling | Metallurgical structure | TS(MPa) | vTr100 (° C.) |
|---|---|---|---|---|---|---|
| | 900° C. then air cooling | | 570° C. then air cooling | | | |
| 3 | Soaking for 10 minutes at 900° C. then air cooling | Rolling from 10 mm to 6 mm thick | Soaking for 20 minutes at 600° C. then air cooling | ferrite + bainite dual phase | 922 | −20 |
| 4 | Soaking for 10 minutes at 900° C. then air cooling | Rolling from 10 mm to 6 mm thick | Soaking for 20 minutes at 520° C. then air cooling | ferrite + bainite dual phase | 869 | −25 |
| 5 | Soaking for 10 minutes at 900° C. then air cooling | Rolling from 10 mm to 6 mm thick | Soaking for 20 minutes at 475° C. then air cooling | ferrite + bainite dual phase | 855 | −20 |
| 6 | Soaking for 10 minutes at 900° C. then air cooling | Rolling from 10 mm to 6 mm thick | Soaking for 20 minutes at 500° C. then air cooling | ferrite + bainite dual phase | 852 | −20 |
| 7 | Soaking for 10 minutes at 900° C. then air cooling | Rolling from 10 mm to 6 mm thick | Soaking for 20 minutes at 470° C. then air cooling | ferrite + bainite dual phase | 856 | −25 |
| 8 | Soaking for 10 minutes at 900° C. then air cooling | Rolling from 10 mm to 6 mm thick | Soaking for 20 minutes at 580° C. then air cooling | ferrite + bainite dual phase | 930 | −20 |
| 9 | Soaking for 10 minutes at 900° C. then air cooling | Rolling from 10 mm to 6 mm thick | Soaking for 20 minutes at 470° C. then air cooling | ferrite + bainite dual phase | 856 | −25 |
| 10 | Soaking for 10 minutes at 900° C. then air cooling | Rolling from 10 mm to 6 mm thick | Soaking for 20 minutes at 600° C. then air cooling | ferrite + bainite dual phase | 956 | −25 |
| 11 | Soaking for 10 minutes at 900° C. then air cooling | Rolling from 10 mm to 6 mm thick | Soaking for 20 minutes at 450° C. then air cooling | ferrite + pearlite dual phase *1 | 734 | −20 |
| 12 | Soaking for 10 minutes at 900° C. then air cooling | Rolling from 10 mm to 6 mm thick | Soaking for 20 minutes at 600° C. then air cooling | ferrite + bainite dual phase | 905 | 20 |
| 13 | Soaking for 10 minutes at 900° then air cooling | Rolling from 10 mm to 6 mm thick | Soaking for 20 minutes at 470° C. then air cooling | ferrite + bainite dual phase *2 | 850 | −10 |
| 14 | Soaking for 10 minutes at 900° C. then air cooling | Rolling from 10 mm to 6 mm thick | Soaking for 20 minutes at 550° C. then air cooling | ferrite + pearlite dual phase *1 | 900 | 10 |
| 15 | Soaking for 10 minutes at 900° C. then air cooling | Rolling from 10 mm to 6 mm thick | Soaking for 20 minutes at 610° C. then air cooling | ferrite + bainite dual phase | 909 | 30 |

*1 The metallurgical structure was outside the range of the present invention;
*2 The ferrite grain diameter coarsened.

As shown in Table 2, for steels No. 1-10 having chemical compositions which satisfied the conditions prescribed by the present invention, the metallurgical structure was a ferrite+bainite dual phase structure and the results for the tensile test and the Charpy impact test were both acceptable. Therefore, it can be seen that these steels were suitable as a material for a steel tube for an airbag accumulator.

In contrast, for steel No. 11, due to the Ceq which was lower than the prescribed range, the tensile strength was too low. For steel No. 12, due to the Ceq which was higher than the prescribed range, even though the tensile strength was acceptable, the result of the Charpy impact test was unacceptable. Steel No. 13 contained neither Ti nor Nb, and the results of the Charpy impact test were unacceptable. For steel No. 14, Ceq was in the prescribed range, but since Mn was too low, the metallurgical structure became ferrite+pearlite and the result of low temperature toughness was unacceptable. For steel No. 15, Ceq satisfied the prescribed range, but since none of Ca, Mg or REM was added, the low temperature toughness was unacceptable.

Example 2

Seamless steel tubes each having an outer diameter of 31.8 mm and a wall thickness of 2.7 mm were prepared in a seamless steel tube mill by the Mannesman-mandrel mill method using steels material (Steels Nos. 16 and 17) having the chemical compositions shown in Table 3.

The seamless steel tube of Steel No. 16 underwent rough working (at a reduction ratio of 35%) so as to give an outer diameter of 25.0 mm and a wall thickness of 2.25 mm by cold drawing in a conventional manner. It was then subjected to normalizing heat treatment by heating to 900° C. and soaking for 5 minutes followed by air cooling. The normalized steel tube underwent cold drawing (at a reduction ratio of 34%) so as to finish it to an outer diameter of 20.0 mm and a wall thickness of 1.85 mm. It was then subjected to stress relief annealing by heating to 500° C. and soaking for 20 minutes followed by air cooling to obtain a product steel tube.

The seamless steel tube of Steel No. 17 was subjected, without rough working, to normalizing heat treatment by heating to 900° C. and soaking for 5 minutes followed by air cooling. The normalized steel tube underwent cold drawing (at a reduction ratio of 41%) so as to finish it to an outer diameter of 25.0 mm and a wall thickness of 2.0 mm. It was then subjected to stress relief annealing by heating to 470° C. and soaking for 20 minutes followed by air cooling to obtain a product steel tube.

The strength, toughness, and burst resistance of each of these two product steel tubes were evaluated in the following manner. The test results are also compiled in Table 3.

Tensile strength was evaluated by the tensile test method for metallic materials specified by JIS Z 2241 using a No. 11 test piece specified by JIS Z 2201 taken in the lengthwise direction of the steel tube.

Evaluation of toughness was carried out in accordance with the Charpy impact test method for metallic materials prescribed by JIS Z 2242 01 using a subsize test piece obtained by cutting a rectangular parallelepiped with a length of 55 mm, a width of 1.85 mm, and a thickness of 10 mm in the circumferential direction (T direction) of a steel tube which was cut open and unrolled at room temperature and imparting a V-shaped notch in the thickness direction at the center of the lengthwise direction, the notch having a notch angle of 45°, a notch depth of 2 mm, and a radius at the bottom of the notch of 0.25 mm.

A bursting test was carried out by cutting three steel tube sections with a length of 250 mm from each product steel tube, welding a lid to each end of each tube section to close the tube section, and increasing an internal pressure of the closed tube section kept at −20° C. until bursting occurred by introducing a liquid (ethanol) into the tube section through an inlet penetrating the lid at one end of the tube section. The burst resistance was evaluated by observing the development of cracks when the tube sections were burst at −20° C.

TABLE 3

| Steel No. | C | Si | Mn | P | S | Cu | Cr | Ni | Mo | Ti |
|---|---|---|---|---|---|---|---|---|---|---|
| 16 | 0.11 | 0.32 | 1.31 | 0.012 | 0.004 | 0.28 | 0.62 | 0.24 | 0.30 | 0.028 |
| 17 | 0.11 | 0.31 | 1.37 | 0.012 | 0.002 | 0.18 | 0.63 | 0.20 | 0.21 | 0.008 |

| Steel No. | Nb | sol. Al | Ca | Ceq | Metal. structure | TS (MPa) | vTrs (° C.) | Bursting test |
|---|---|---|---|---|---|---|---|---|
| 16 | 0.021 | 0.050 | 0.0020 | 0.560 | ferrite + bainite dual phase | 955 | −20 | Good - No propagation of cracks in all 3 tube sections |
| 17 | 0.028 | .044 | 0.0014 | 0.545 | ferrite + bainite dual phase | 959 | −20 | Good - No propagation of cracks in all 3 tube sections |

As shown in Table 3, the tensile strength, toughness, and burst resistance were good for the seamless steel tubes of both Steels Nos. 16 and 17. These results confirmed that a seamless steel tube according to the present invention has satisfactory properties for use as an airbag accumulator. Namely, not only in the case where cold working was performed in two stages consisting of rough working prior to normalizing heat treatment and finishing working after the heat treatment (Steel No. 16) but also in the case where a product steel tube was obtained only by finishing working without previous rough working (Steel No. 17), it was possible to manufacture a seamless steel tube having the properties required for an airbag 1 accumulator only with a heat treatment in the form of normalizing without quenching and tempering.

FIG. 1 is a graph showing a comparison of the relationship between Ceq and tensile strength for the steels according to the present invention in Table 1 (Steels Nos. 1-10 and Nos. 16 and 17) compared to that for examples of Patent Documents 5 and 6. As can be seen from this FIGURE, in the present invention, a material having a considerably high strength can be obtained. Of course, the low temperature toughness of a material of the present invention was also excellent, and its superiority with respect to actual burst resistance was ascertained, so it is an excellent material for use in an airbag accumulator.

The invention claimed is:

1. A seamless steel tube for an airbag accumulator characterized by having a steel composition consisting essentially, in mass %, of C: 0.08-0.20%, Si: 0.1-1.0%, Mn: 0.6-1.6%, P: at most 0.025%, S: at most 0.010%, Cr: 0.05-0.8%, Mo: 0.05-1.0%, Al: 0.002-0.10%, at least one of Ca: 0.0003-0.01%, Mg: 0.0003-0.01%, and REM (rare earth metals): 0.0003-0.01%, at least one of Ti: 0.002-0.1% and Nb: 0.002-0.1%, with Ceq which is defined by the following Equation (1) being in the range of 0.45-0.63, and a remainder of Fe and impurities, with the metallurgical structure being a mixed structure of ferrite+bainite having an area fraction of bainite of at least 10%, and having a tensile strength of 850 MPa or more and a vTrs 100 value of −20° C. or less:

$$Ceq = C + Si/24 + Mn/6 + (Cr+Mo)/5 + (Ni+Cu)/15 \quad (1)$$

wherein the symbol for each element in Equation (1) indicates the number expressing the mass percent of the element.

2. A seamless steel tube for an airbag accumulator as set forth in claim 1 wherein a portion of Fe in the steel composition is replaced by one or more of Cu: 0.05-0.5% and Ni: 0.05-1.5%.

3. A process of manufacturing a seamless steel tube for an airbag accumulator comprising a step of forming a seamless steel tube having a steel composition as set forth in claim 1 or 2 and a step of subjecting the steel tube to finishing cold working so as to provide it with prescribed dimensions, characterized in that the process comprising a step of performing normalizing heat treatment on the steel tube prior to the finishing cold working step by heating the steel tube to a temperature in the range from the $Ac_3$ transformation point to 1,000° C. followed by air cooling.

4. A process of manufacturing a seamless steel tube for an airbag accumulator as set forth in claim 3 wherein the finishing cold working step is performed by cold drawing.

5. A process of manufacturing a seamless steel tube for an airbag accumulator as set forth in claim 3 which further comprises a step of performing stress relief annealing on the steel tube at a temperature of 450-650° C. after the finishing cold working step.

6. A process of manufacturing a seamless steel tube for an airbag accumulator as set forth in claim 3 which further comprises a step of performing rough working by cold working on the steel tube before the normalizing heat treatment step.

7. An airbag accumulator comprising a seamless steel tube having a steel composition consisting essentially, in mass %, of C: 0.08-0.20%, Si: 0.1-1.0%, Mn: 0.6-1.6%, P: at most 0.025%, S: at most 0.010%, Cr: 0.05-0.8%, Mo: 0.05-1.0%, Al: 0.002-0.10%, at least one of Ca: 0.0003-0.01%, Mg: 0.0003-0.01%, and REM (rare earth metals): 0.0003-0.01%, at least one of Ti: 0.002-0.1% and Nb: 0.002-0.1%, with Ceq which is defined by the following Equation (1) being in the range of 0.45-0.63, and a remainder of Fe and impurities, with the metallurgical structure being a mixed structure of ferrite+bainite having an area fraction of bainite of at least 10%, and having a tensile strength of 850 MPa or more and a vTrs100 value of −20° C. or less:

$$Ceq = C + Si/24 + Mn/6 + (Cr+Mo)/5 + (Ni+Cu)/15 \quad (1)$$

wherein the symbol for each element in Equation (1) indicates the number expressing the mass percent of the element.

8. An airbag accumulator as set forth in claim 7 wherein a portion of Fe in the steel composition of the seamless steel tube is replaced by one or more of Cu: 0.05-0.5% and Ni: 0.05-1.5%.

* * * * *

UNITED STATES PATENT AND TRADEMARK OFFICE

CERTIFICATE OF CORRECTION

PATENT NO. : 8,496,763 B2
APPLICATION NO. : 12/429851
DATED : July 30, 2013
INVENTOR(S) : Arai et al.

It is certified that error appears in the above-identified patent and that said Letters Patent is hereby corrected as shown below:

On the Title Page, in Item (57), under "ABSTRACT", in Column 2, Line 5, delete "stee;" and insert -- steel --, therefor.

Signed and Sealed this
Seventeenth Day of November, 2015

Michelle K. Lee

Michelle K. Lee
*Director of the United States Patent and Trademark Office*